United States Patent [19]

Burrows

[11] 4,057,917

[45] Nov. 15, 1977

[54] METHOD OF PADDING PIPE

[76] Inventor: Norman B. Burrows, Rte. 2, Box 3109, Odessa, Tex. 79763

[21] Appl. No.: 672,023

[22] Filed: Mar. 30, 1976

Related U.S. Application Data

[62] Division of Ser. No. 619,948, Oct. 6, 1975, Pat. No. 3,981,089.

[51] Int. Cl.[2] ..... E02F 5/22

[52] U.S. Cl. ..... 37/195

[58] Field of Search ..... 37/7, 8, 142.5, 189, 37/195; 111/6, 7; 214/83.3, 83.36, 44 A, 302, 518, 519; 61/35, 36, 37, 63, 105, 107

[56] References Cited

U.S. PATENT DOCUMENTS

| | | | |
|---|---|---|---|
| 2,602,388 | 7/1952 | Elliott et al. | 111/6 X |
| 2,694,499 | 11/1954 | Mohrlang et al. | 214/518 |
| 2,857,691 | 10/1958 | Curran | 37/142.5 X |
| 2,931,529 | 4/1960 | Osterhaus | 214/519 |
| 3,224,120 | 12/1965 | Wilmoth et al. | 37/142.5 X |
| 3,396,481 | 8/1968 | Hovorak | 37/8 X |
| 3,446,026 | 5/1969 | Fikse | 61/35 |
| 3,507,060 | 4/1970 | Gee et al. | 37/8 |
| 3,511,056 | 5/1970 | Jones | 61/35 |
| 3,583,168 | 6/1971 | Horton | 37/142.5 X |
| 3,596,384 | 8/1971 | Neujahr | 37/142.5 |
| 3,597,927 | 8/1971 | Hemphill | 61/35 |
| 3,701,422 | 10/1972 | Downey | 37/8 X |
| 3,978,673 | 9/1976 | Schleede | 111/7 X |

FOREIGN PATENT DOCUMENTS

| | | | |
|---|---|---|---|
| 1,361,611 | 7/1974 | United Kingdom | 37/142.5 |
| 1,419,628 | 4/1973 | United Kingdom | 37/142.5 |

*Primary Examiner*—E. H. Eickholt
*Attorney, Agent, or Firm*—Marcus L. Bates

[57] ABSTRACT

A machine for distributing padding material within a previously dug ditch so that a pipe placed within the ditch is protected from objectional objects which may otherwise cause damage thereto.

The padding machine comprises an earth moving vehicle having a laterally arranged conveyor means connected thereto, so that padding material can be transported laterally away from the vehicle and into a ditch while the machine travels along a parallel path respective to the ditch.

10 Claims, 7 Drawing Figures

METHOD OF PADDING PIPE

REFERENCE TO RELATED APPLICATIONS

Ser. No. 619,948, filed Oct. 6, 1975, for "Improvements in Padding Machines" now U.S. Pat. No. 3,981,089, of which the instant application is a voluntary divisional.

BACKGROUND OF THE INVENTION

Cross-country pipelines are extremely expensive to construct and must therefore be designed to retain their structural integrity for many years if the initial cost thereof is to be recouped. The exterior of the pipe is usually wrapped with a protective covering, which insulates the pipe from moisture and prevents the occurence of electrolysis, thereby greatly minimizing corrosion thereof. Should the outer surface of the pipe inadvertently contact a sharp object, such as a rock, repeated movement of the pipe due to thermal expansion will soon abrade away the covering and eventually expose the exterior metallic surfaces of the pipe to the deleterious effects of ambient. Subsequently, corrosive action and various other chemical reactions commence, and eventually the pipe must be uncovered and repaired. This is an expensive endeavor which can only be avoided by initially padding the entire outer peripheral surface of the pipeline with a suitable padding material. The padding material is usually comprised of sand or other earthen products, such as finely commuted limestone.

Heretofore it has been necessary to dig the pipeline ditch in such a manner that the excavated earth is placed in a coextensive line to one side thereof, and thereafter the opposed side of the ground contiguous thereto is scraped free of debris. Next, a continuous line of suitable padding material is spread on the cleansed area adjacent to the ditch so that earth handling vehicles, such as a maintainer, can subsequently "blade" a portion of the deposited padding material into the ditch. After the pipe has been positioned within the ditch where it is laid upon the padding material, the maintainer must again scrape another portion of the remaining padding material onto the top of the pipe. A generous portion of the padding material is deliberately left behind to minimize the probability of inadvertently scraping rocks and other harmful debris onto the top of the pipe.

The above-described prior operation is costly because it fails to utilize all of the padding material. Furthermore, the padding material is never uniformly distributed. Moreover, wind or rainstorms will often scatter the stored padding material, causing portions of the operation to be repeated.

Accordingly, it is desirable to have made available a padding machine within which padding can be stored for transporting, thereby enabling the machine to travel parallel and adjacent to a pipeline ditch in such a manner that padding material can be translocated directly from the vehicle into the ditch where the pipe is padded in a uniform and optimum manner.

This expedient eliminates the waste involved in the above-described prior art operation; and furthermore, more efficiently pads or insulates the pipe in a rapid and relatively inexpensive manner.

SUMMARY OF THE INVENTION

This invention encompasses improvements in padding machines for distributing padding material within a previously dug ditch. The padding machine is in the form of an earth moving vehicle having a container within which padding material is stored so that it can be transported and subsequently dispensed therefrom. A movable wall of the container forces the material toward an opposed vertically movable wall. The vertically movable wall cooperates with the container interior to form an outlet in the form of a valve means through which a controllable flow of padding material occurs.

A laterally arranged conveyer system receives padding material from the valve and transports the material to a dumping location along side the machine. The machine can therefore continuously unload padding material into a ditch while the machine is driven parallel to and along side the ditch. The position of the movable walls and the speed of the conveyor are each controlled in a manner to uniformly cover the bottom of the ditch with the padding material in a new and unobvious manner.

Accordingly, a primary object of this invention is the provision of an improved padding machine which places padding material within a ditch.

An equally important object of this invention is to provide a method of transferring padding material from an earth moving vehicle into a previously dug ditch.

Another object of the invention is to provide a conveyor system for use in conjunction with an earth moving vehicle which enables the vehicle to be used as a padding machine.

A further object of this invention is to disclose and provide a conveyor system in combination with an earth moving vehicle which enables the vehicle to distribute padding material about a pipe located within a ditch.

A still further object of this invention is to disclose and provide a removably mounted conveyor system mounted on an earth moving vehicle which conveys padding material laterally from the vehicle into a pipe line ditch lying parallel to the path of travel thereof.

Another and still further object of this invention is to provide a new combination of an earth moving vehicle and a conveyor system which enables padding material to be transferred directly from the vehicle interior into a ditch spaced therefrom as the vehicle travels in a direction parallel to the ditch.

An additional object of this invention is to provision of improvements in padding machines wherein a pipe lying in a ditch can be insulated with padding material in an unexpected and superior manner.

These and various other objects and advantages of the invention will become readily apparent to those skilled in the art upon reading the following detailed description and claims and by referring to the accompanying drawings.

The above objects are attained in accordance with the present invention by the provision of a combination of elements which broadly are fabricated in a manner substantially as described in the above abstract and summary.

DETAILED DESCRIPTION OF THE PREFERRED EMBODIMENTS

Throughout the various figures of the drawings, wherever it is possible or logical to do so, like or similar numerals refer to and identify like or similar parts.

Figure 1:
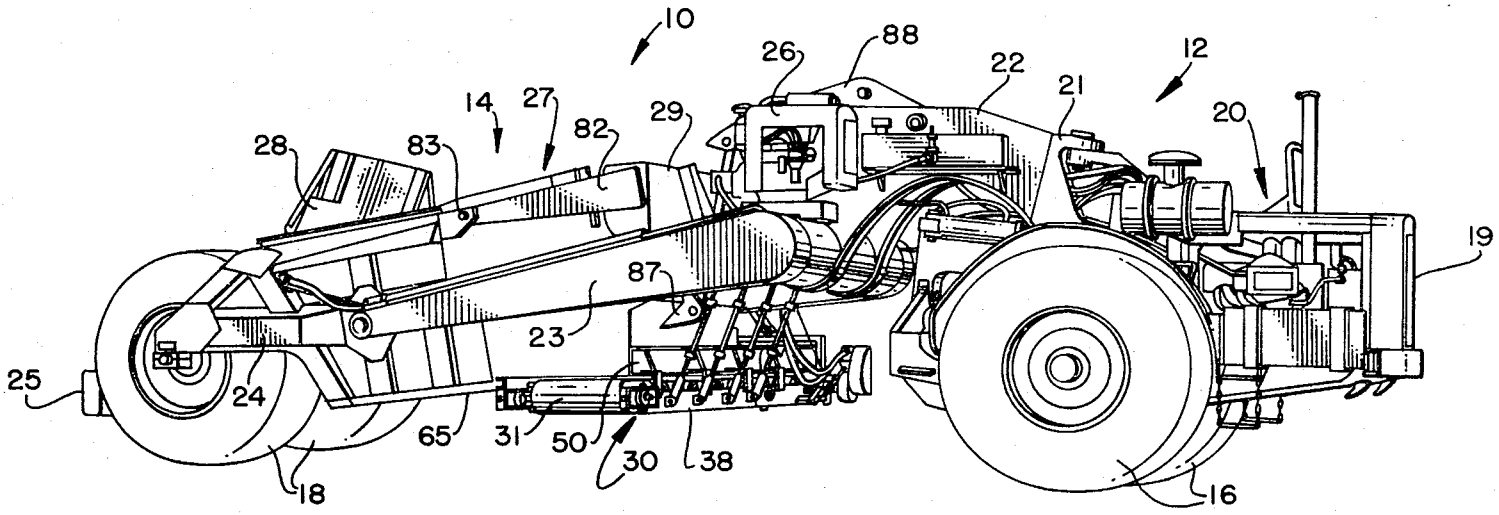
FIG. 1 is a perspective side view of a padding machine made in accordance with the present invention.

In FIG. 1 of the drawings, together with some of the remaining Figures thereof, there is disclosed a padding machine 10 made in accordance with the present invention. The machine is in the form of an earth moving vehicle and includes a prime mover section 12 which guidably propels a distributing section 14 thereof. The padding machine is ground supported by the illustrated front and rear pneumatic tires 16 and 18. The front end 19 of the machine is forwardly placed ahead of the driver, who is seated in the general area indicated by numeral 20.

Trunion 21 is journaled to the prime mover and forms the forward end portion of a monocoque spar 22. The spar 22 is bifurcated so that it supports a pair of a parallel spaced main lateral support members 23. Rearwardly spaced apart support members 24 are journaled to a pair of tires 18 in the usual manner. Numeral 25 indicates a bumper which defines the rearwardmost portion of the machine.

An internal combustion engine 26 drives the illustrated hydraulic pump, so that hydraulic power is available for the operation of the distributing section of the apparatus. The distributing section includes an upwardly opening container which admits padding material to be charged thereinto at 27. The container is defined by the illustrated fixed opposed side walls, a horizontally movable rear wall 28, and a vertically movable front wall 29.

A conveyer means 30 underlies the lower forward marginal end of the container and includes a charging end 31 and a delivery end 32.

Figure 3:
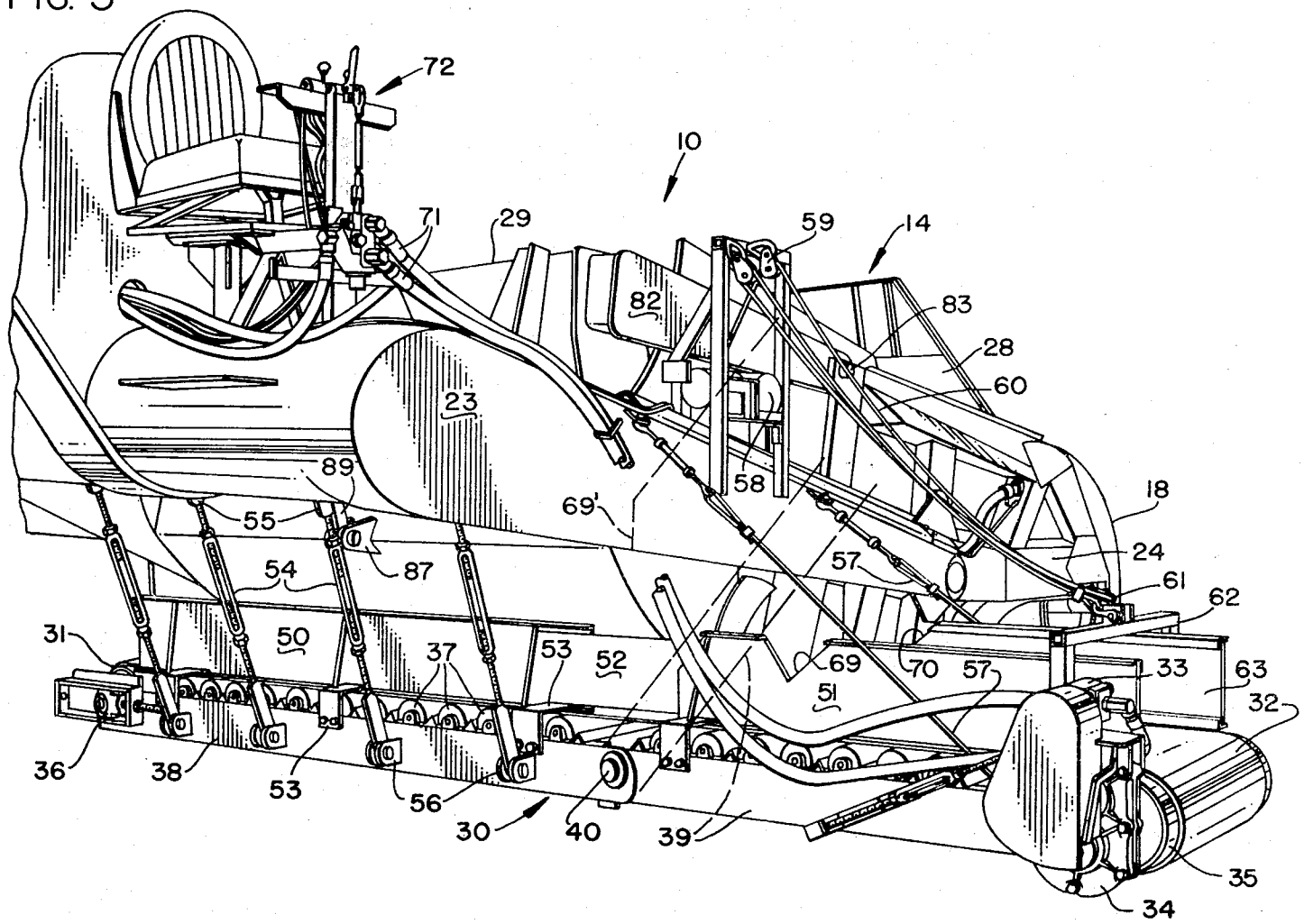
FIG. 3 is an enlarged, broken, perspective view which disclosed the opposite side of the machine seen in FIGS. 1 and 2.
Figure 4:
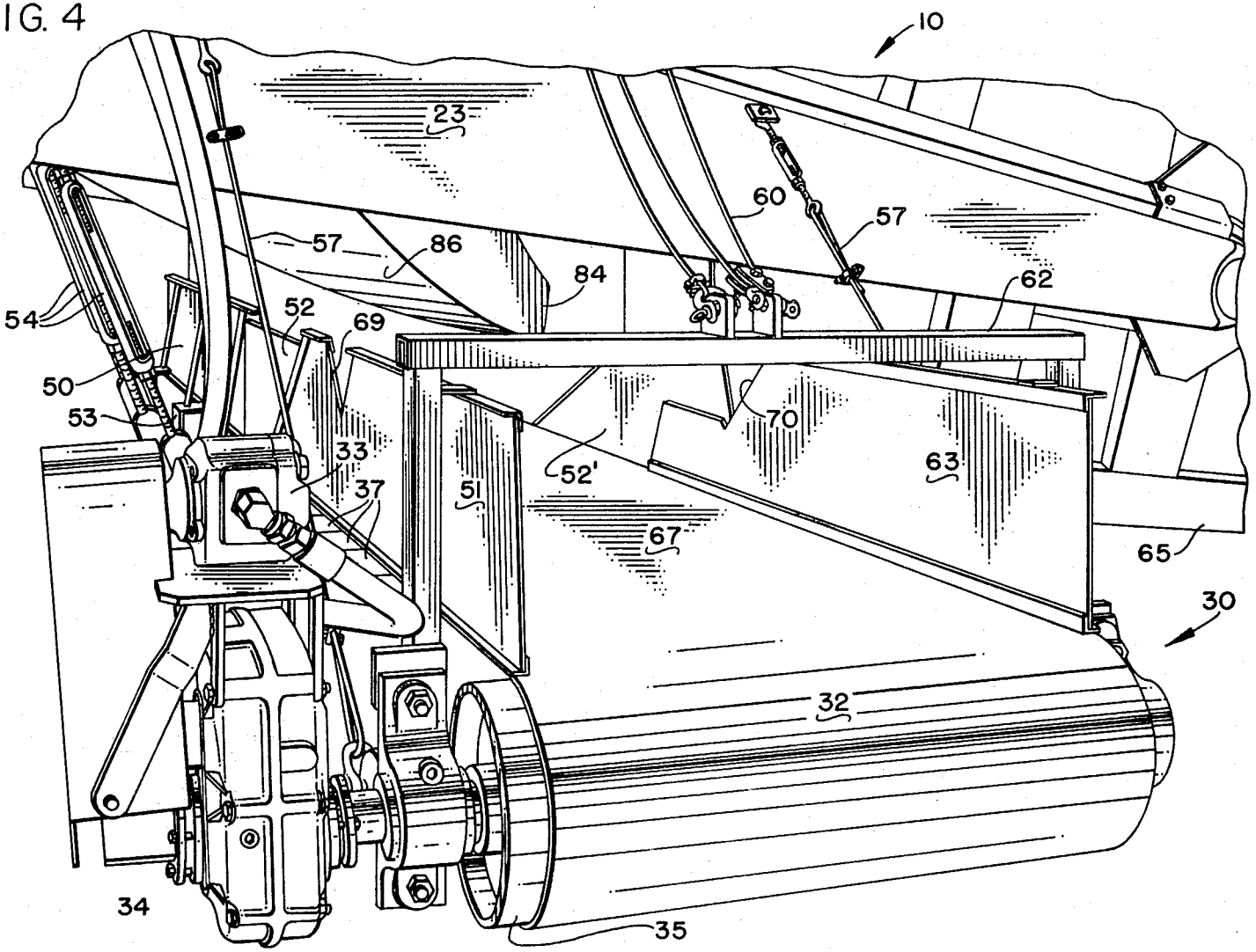
FIG. 4 is an enlarged, fragmentary, perspective detail of part of the apparatus disclosed in the foregoing figures.

As best seen illustrated in FIGS. 3 and 4, a hydraulic motor is housed at 33 and is operatively connected to a reduction gear assembly 34. The reduction gear assembly is connected to a powdered roller 35 which forms the before-mentioned delivery end of the apparatus. The opposed end 31 of the conveyer is likewise provided with a roller having an adjustable journal means 36 associated therewith. Idler rollers 37 are disposed at various intermediate locations between the opposed end rollers. The end rollers are held in spaced apart relationship by a pair of spaced beam members, one of which is seen at numeral 38.

The delivery end of the conveyer has a marginal portion 39 thereof journaled to the main support beam at pivot point 40 in such a manner that roller 35 can be pivoted thereabout so that marginal end 39 of the conveyer assumes almost a vertical position.

Figure 2:
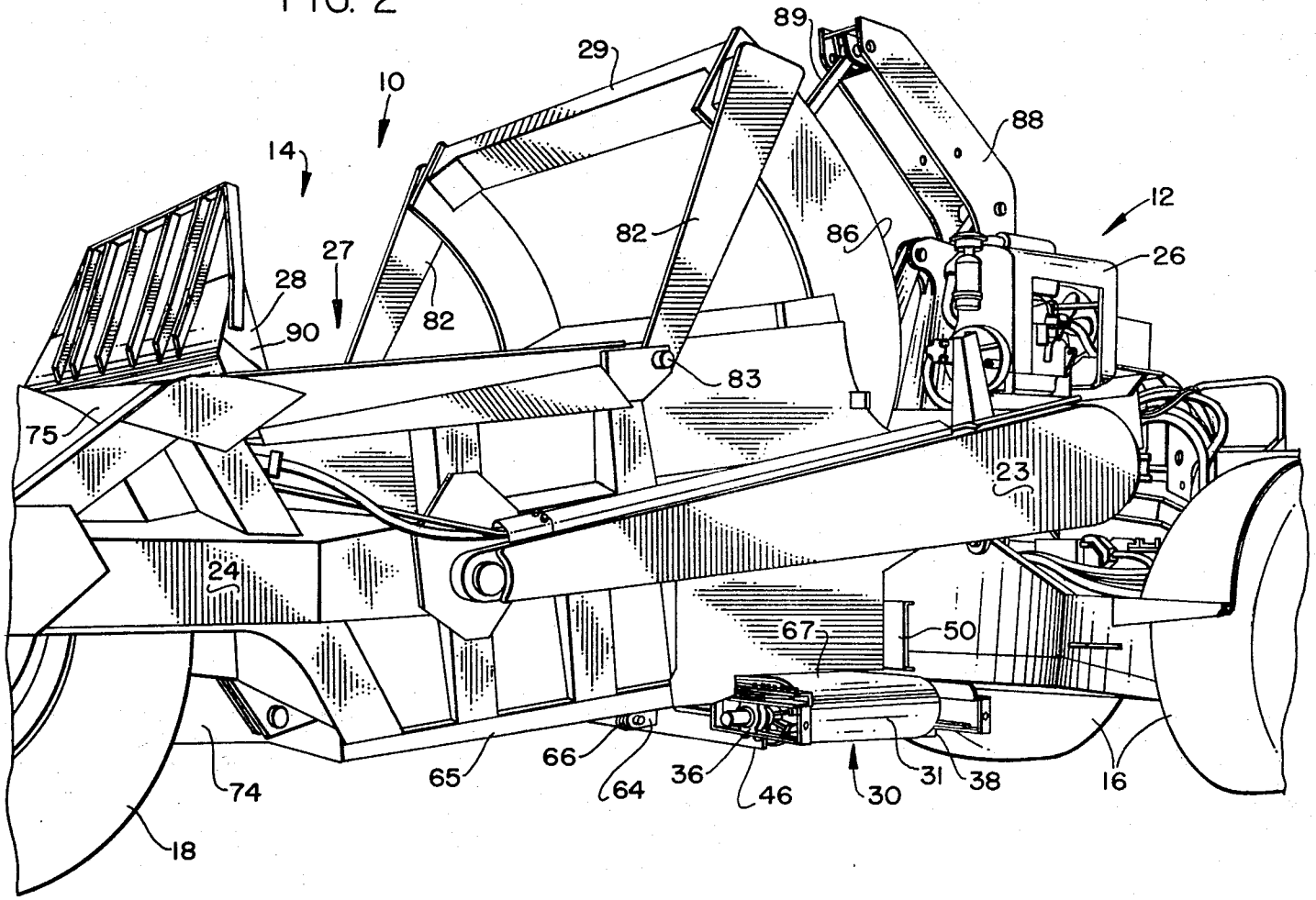
FIG. 2 is a broken, enlarged, perspective side view of the machine disclosed in FIG. 1.
Figure 5:
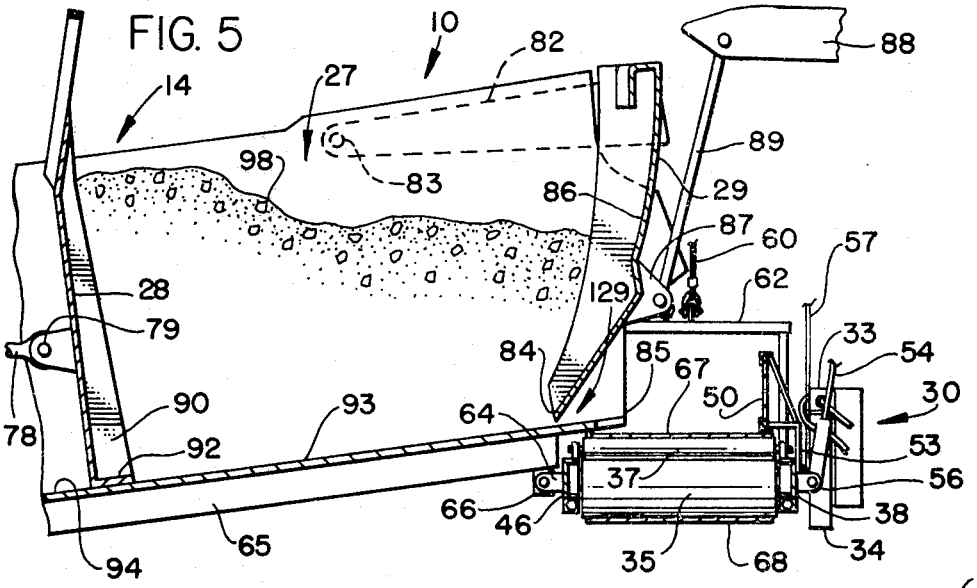
FIG. 5 is a broken, part cross-sectional, side view of part of the apparatus disclosed in the foregoing figures.
Figure 6:
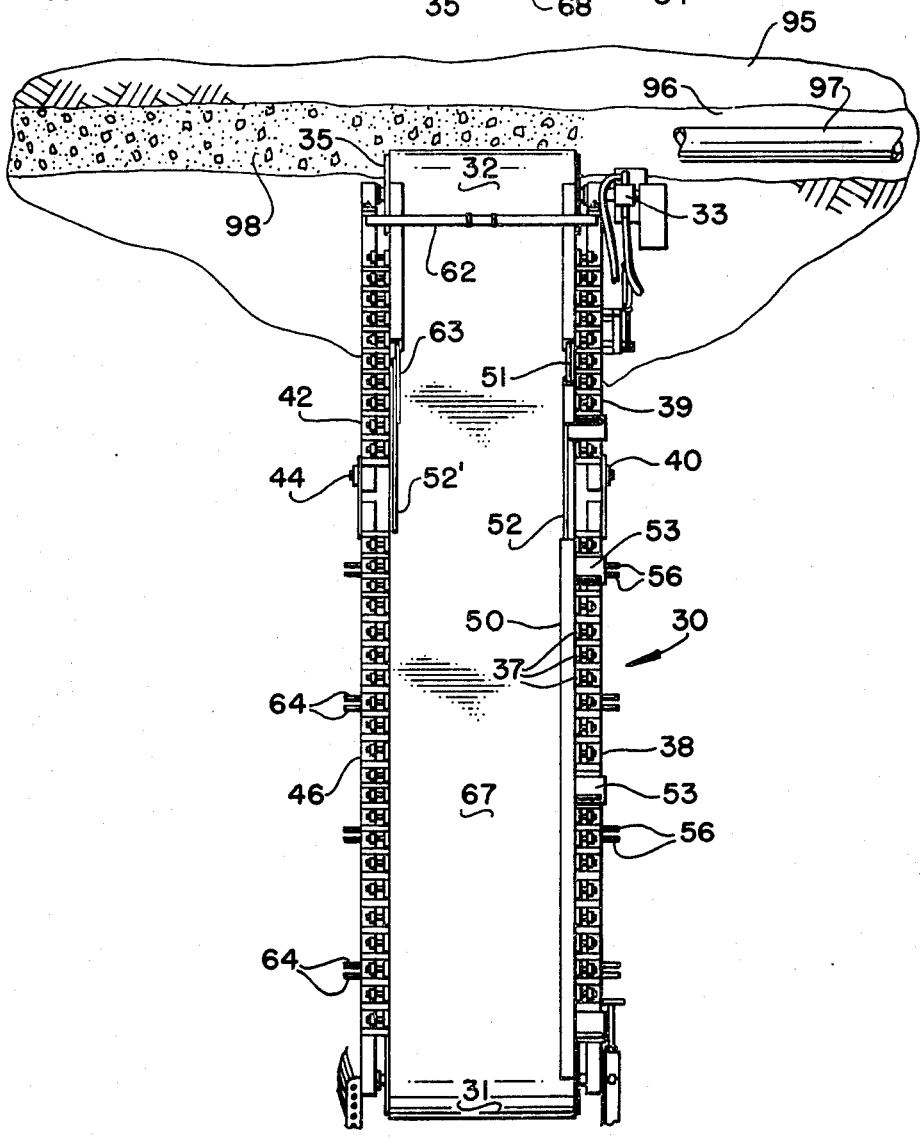
FIG. 6 is an isolated, top plan view of part of the apparatus disclosed in the foregoing figures; and, FIG. 7 is a broken top plan view which discloses some of the operative features of the apparatus disclosed in FIGS. 1 and 2.

As seen in FIGS. 2, 5, and 6, the conveyer includes members 42, 44, 46, which are opposed to the corresponding before mentioned members 38, 39, and 40.

As seen in FIG. 3, vertical side boards 50 and 51 prevent spillage of padding material from the top surface of the conveyer and are interconnected by a flexible, resilient, intermediate member 52. The member 52 preferably is in the form of a thick piece of rubber sheeting. The side boards are affixed to beams 38 and 39 by brackets 53. Adjustable elongated support members 54 preferably are in the form of a turnbuckle, and each are arranged at a suitable angle to connect the fixed beam 38 to the forward portion of the spar 23 by means of the attachment fittings seen illustrated at 55. The turnbuckles each have a lower end portion removably pinned to the illustrated forwardly disposed ears of brackets 56, so that removal of the pins therefrom will permit the entire forward side 38 of the conveyer to be disconnected from the spar. Hence beams 38 and 39 can be rotated about the opposed coextensive beams 46 and 42.

The foldable or pivotal portion 39 of the conveyer is supported horizontally by a pair of adjustable guy wires 57. Winch motor 58 places tension on a cable 60, which is roved through an upper block member 59 and a lower block member 61. The lower block is affixed to a vertical standard 62, with the legs of the standard being rigidly affixed to the opposed beam members of the foldable portion 39 of the conveyer. The standard also lends support to the opposed side boards 51 and 63.

As seen in FIGS. 5 and 6, the rear beam 46 of the conveyer is provided with brackets or ears 64, similar to the before mentioned ears 56. The spaced apart ears 64 are pinned to the illustrated downwardly depending bracket 66 by the illustrated removable pin, so that when the pin is removed, the ears are disengaged from the bracket and the conveyer is released from the floor superstructure 65. The superstructure rigidifies the bottom of the container.

The conveyer includes an endless belt having an upper material receiving surface 67 and a lower surface 68. When end 32 of the conveyer is pivoted about pivot pin 40, cutout 69 receives the lower edge portion of the main body spar at 69' therewithin to thereby enable the effective width of the machine to be greatly reduced. The opposed side board is provided with a similar cutout 70. Flexible sideboard member 52' bridges the gap from cutout 70 to the container outlet. This particular mechanical expedient brings about an unusual attribute of the machine in that transportation from one to another geographical location is effected quickly and economically.

Quick disconnects 71 are of conventional design and enable the illustrated hydraulic hoses to be removed along with the conveyer, thereby enabling the entire conveyer to be rapidly removed from the remainder of the distributing section of the invention. This expedient further reduces the effective width of the machine and further enhances its relocation between job sites.

Control console 72 controls the flow of hydraulic fluid between the hoses connected at 71, thereby enabling the operator to control the speed with which the conveyer surface 67 moves. The console further controls other operative parameters of the distribution section as will be better appreciated later on in this disclosure.

Figure 7:
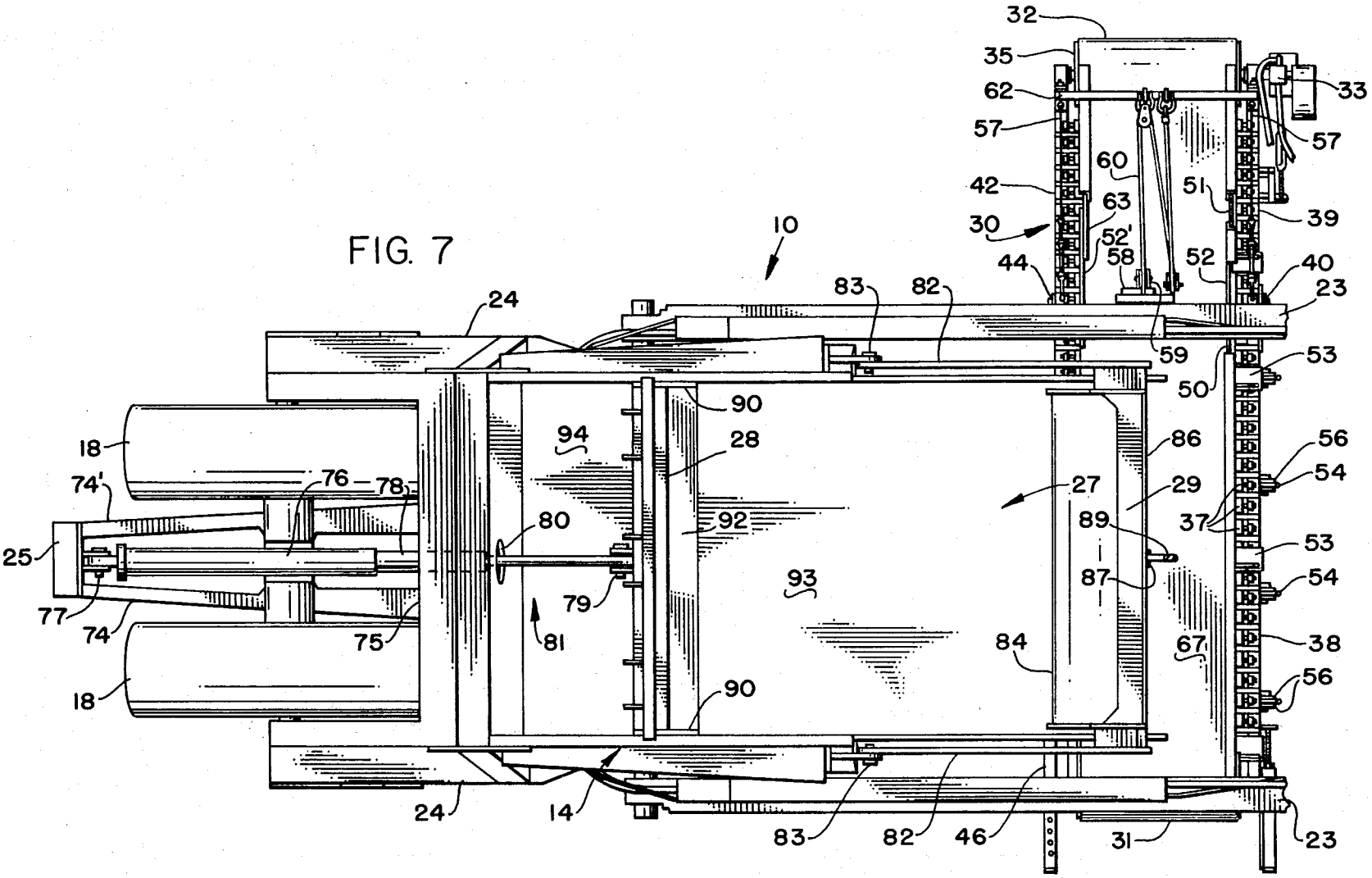

As best seen in FIG. 7, the rear bumper 25 is supported by a pair of rearwardly converging beam members 74, 74' which are rigidly affixed to a vertical support member 75. Support member 75 is tied to the main spar 24, while a hydraulic cylinder 76 is pivotally affixed to the bumper at 77. The piston 78 of the cylinder assembly is affixed at bracket 79 to the movable wall 28. Aperture 80 formed through support 75 telescopingly receives the piston therethrough.

Looking again to the details of FIG. 5, the vertically movable bulkhead 29 is seen to be in the form of a clam shell, having the upper opposed marginal edges thereof attached to a pair of spaced arms 82, with the arms being pivotally mounted to the side walls of the container at pivot point 83. The bottom edge portion 84 of the clam shell is pivoted into a position located rearwardly of a ledger plate 85. Curved wall 86 of the clam shell forms the forward wall of the container. Bracket 87 is affixed to the outer and forward clam shell wall and then to the free end of a hydraulically actuated bell crank 88 by means of a link 89.

Vertical upward motion of the door 29 is brought about by counterclockwise pivotal movement of the clam shell and thereby enlarges the outlet opening 129 to increase the flow of padding material therethrough. Hence movement of the clam shell is analogous to the operation of a valve means.

Horizontally movable wall 28 includes the illustrated spaced apart side portions 90, each of which slidably engage the opposed side walls of the container so that a minimal amount of padding material is lost therebetween. Horizontal web 92 preferably is spaced slightly above floor 93 and effectively prevents any appreciable flow of padding material therebetween. Numeral 94 illustrates a portion of the floor which presently lies without the container.

In FIG. 6, the ground 95 surrounds a ditch 96 within which a pipe 97 has been placed. Padding material 98 covers the pipe and prevents damage thereto. Often, padding material will be placed both above and below the pipe, sometimes requiring two trips along the ditch by the machine.

In operation, the clam shell valve or outlet is closed so that the lower edge portion 84 thereof engages the floor 93 of the container. The rear wall is moved to an extreme rearward position away from the clam shell to thereby provide a large upwardly opening container through which suitable padding material can be charged through inlet 27.

A driver is seated at 20 and pilots the machine so that the delivery end 32 of the conveyer will discharge padding material into a ditch 96, thereby covering a pipe 97 with several inches of finely divided material. The material insulates the outer peripheral surface of the pipe from subsequent injury.

An operator seated at console 72 controls the operation of members 28, 29, and 30. The operator also can communicate with the driver, thereby effectively controlling the prime mover section so that its speed and position relative to the ditch is maintained under satisfactory operation. The console enables the operator to control the action of the rear bulkhead so as to maintain an ample supply of padding material flowing through the outlet, as well as controlling the speed of the conveyer. One interesting aspect of the present invention is that the speed of the conveyer can be regulated to compensate for changes in driver speed in such a manner to maintain a constant depth of the padding material within the ditch.

Another unexpected attribute of the present invention is that the conveyer speed can be reduced to zero, whereupon padding material will continue to flow through the outlet onto the conveyer until the level thereof reaches the lower end portion 84 of the clam shell, whereupon further flow of padding material is automatically or inherently discontinued. Accordingly, while padding a pipe, should the driver unexpectedly stop the vehicle, the operator merely slows the conveyer speed to a stop and leaves the clam shell in its last optimum position. As the driver resumes travel, the operator can again start the conveyer moving at a slower speed and progressively increase the conveyer speed until the accumulated padding material has been satisfactorily disposed of and placed within the ditch.

In order to transport the machine along private roads, the winch 58 is engaged, thereby folding the marginal portion 39 of the conveyer against the side of the machine. This expedient greatly reduces the effective width of the machine, however, the width remains excessive for travel along a highway.

When it is desired to transport the machine along public roadways, it is necessary to further reduce the width of the machine. For this reason, it is desirable that the entire conveyer system be disconnected therefrom and transported on a separate trailer. The conveyer is easily removed from the machine by removing the pins at 56 and 64.

Removal of the four pins at 56 enables the beam 38 to be pivoted downwardly onto a support block or the like, or directly onto a trailer. Next, the four pins at 64 or 66 are removed and the beam 46 set down on a suitable support means. Block 61 is next removed, and cable ends 57 unhooked. The hydraulic hoses are then rapidly removed from the machine and may be transported along with the conveyer.

Since the downwardly disposed lugs 64 are an integral part of the floor structure 65, and the floor structure 65 is tied into the walls and into the opposed spars 23, it stands to reason that beam 46 is rigidly tied to the superstructure of the container in a manner which imparts the conveyer with a pivotal motion respective to the pivot pins at 64. Beam 38 is tied to the superstructure by means of the turnbuckles 64 so that the angular disposition of surface 57 can be adjusted respective to the remainder of the machine.

I claim:

1. A method of placing padding material within a previously dug ditch comprising the steps of:

mounting a container and a lateral conveyor onto an earth bound vehicle;

placing padding material within said container moving said vehicle along a path of travel which is spaced from, adjacent to, and parallel to said ditch;

forming an outlet within said container and forcing said padding material contained within said container to move through said outlet;

forcing padding material to flow through said outlet by moving opposed walls of said container toward one another so that any padding material contained therebetween is forced to move towards and through said outlet;

receiving material which flows through said outlet by said lateral conveyor;

conveying padding material laterally away from said outlet and into said ditch, thereby uniformly placing padding material within said ditch.

2. The method of claim 1 and further including the step of forming said outlet in a lower extremity of said container and positioning said conveyor therebelow so that the padding material is forced from said container, through said outlet, onto said conveyor, where the padding material is then transported to a position overlying said ditch, whereupon the padding material flows from the conveyor and into the ditch by gravity.

3. The method of claim 15 and further including the step of forming said container into an upwardly opening enclosure so that padding material can be charged into said container through the opening.

4. The method of claim 1 and further including the steps of removably mounting said conveyor respective to said container so that the conveyor can be removed from the container when it is desired to reduce the effective width of the apparatus.

5. The method of claim 4 and further including the steps of folding said conveyor at a location along its length to thereby effectively reduce the overall width of the apparatus for transportation purposes.

6. The method of claim 1 and further including the following steps:

forming said outlet by the provision of a movable wall which moves respective to the container, so that a variable opening is provided for regulating the flow of padding material therethrough; and, adjusting the speed with which the conveyor moves padding material deposited thereon so that the rate with which padding material is discharged from the container into the ditch can be regulated to uniformly place the padding material within the ditch, and to enable the rate of discharge of padding material to be consistent with the speed of the vehicle as it travels along the length of the ditch.

7. Method of placing padding material within a previously dug ditch comprising the steps of:

mounting a container upon a vehicle and moving the vehicle along the surface of the ground in spaced, elevated relation respective to said ditch and in a direction parallel to the length of said previously dug ditch;

forming an outlet in said container through which padding material can flow by moving a wall of said container respective to the bottom thereof thereby forming a variable outlet between the wall and bottom;

storing padding material within said container;

forcing padding material to flow from the interior of said container and through said outlet by moving opposed walls of said container toward one another so that any padding material contained therebetween is forced to move towards and through said outlet;

placing a conveyor in underlying relationship respective to said outlet and arranging the conveyor to transport padding material in a direction normal to the length of said ditch; and, extending said conveyor into an overlying position respective to said ditch so that padding material is forced from said container, through said outlet, and onto said conveyor, where the conveyor transfers the padding material into overlying relationship respective to the ditch and thereby deposits padding material within the ditch.

8. Method of distributing padding material within a previously dug ditch, comprising the steps of:

filling a container with padding material;

moving said container along a path which is spaced from, parallel, and adjacent to said previously dug ditch;

forming an outlet in the lower extremity of said container by moving one of the walls which forms the container respective to the bottom of the container thereby forming a variable outlet between the last said wall and the floor;

forcing padding material towards said outlet by moving opposed walls which form the container toward each other so that any padding material contained therewithin is forced through said outlet;

whereby said one of said opposed walls can be raised to increase the area of said outlet while the remaining of said opposed walls can be forced toward said movable wall to thereby force any padding material contained within said container through said outlet;

placing a conveyor laterally of said path of travel and extending said conveyor until the outlet thereof is positioned to discharge padding material into said ditch;

conveying padding material with said conveyor away from said outlet and laterally away from said container and into said ditch.

9. The method of claim 8 and further including the steps of:

detachably mounting said conveyor in underlying relationship respective to said outlet so that said conveyor can be removed to thereby effectively reduce the width of the apparatus.

10. Method of distributing padding material within a previously dug ditch comprising the steps of:

storing padding material in an upwardly opening container;

supporting said container from a ground supported vehicle and moving the vehicle alongside and parallel to the ditch;

forming an outlet in said container and forcing padding material from said container and through said outlet by moving opposed walls which form the container toward each other so that any padding material contained therewithin is forced through said outlet;

forming said outlet by moving one of said opposed walls respective to the bottom of the container thereby forming a variable outlet between said wall and floor, whereby said one of said opposed walls can be raised to increase the area of said outlet while the remaining of said opposed walls can be forced toward said movable wall to thereby force any padding material contained within said container through said outlet;

forcing a continuous flow of padding material from the interior of the container and through said outlet;

mounting a conveyor means in underlying relationship respective to said outlet and extending the conveyor means laterally away from the path of travel of the vehicle with the discharge end of the conveyor being arranged such that padding material exiting therefrom gravitates into said previously dug ditch;

adjusting the speed with which the conveyor transports material from said outlet, and adjusting the size of said outlet, so that the rate of discharge of padding material into the ditch can be regulated respective to the speed of the vehicle as it travels alongside the ditch to thereby enable a uniform and predetermined amount of padding material to be placed within the ditch.

* * * * *

UNITED STATES PATENT OFFICE

CERTIFICATE OF CORRECTION

PATENT NO. : 4,057,917

DATED : November 15, 1977

INVENTOR(S) : Norman B. Burrows

It is certified that error appears in the above-identified patent and that said Letters Patent are hereby corrected as shown below:

Column 1, line 59, insert --material-- after "padding".

Column 2, line 51, substitute --the-- for "to".

Column 3, line 4, substitute --discloses-- for "disclosed".

Column 3, line 57, substitute --powered-- for "powdered".

Column 7, line 12, substitute --Claim 1-- for "claim 15".

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*